US010501984B2

(12) United States Patent
Balay et al.

(10) Patent No.: US 10,501,984 B2
(45) Date of Patent: Dec. 10, 2019

(54) OVERHEAD CLOSURE WITH TUBE AND HOOK END LOCK

(71) Applicant: CIW Enterprises, Inc., Mountain Top, PA (US)

(72) Inventors: Thomas Balay, Drums, PA (US); Joseph L. Balay, Sugarloaf, PA (US)

(73) Assignee: CornellCookson, LLC, Mountaintop, PA (US)

( * ) Notice: Subject to any disclaimer, the term of this patent is extended or adjusted under 35 U.S.C. 154(b) by 221 days.

(21) Appl. No.: 15/492,285

(22) Filed: Apr. 20, 2017

(65) Prior Publication Data

US 2018/0305977 A1 Oct. 25, 2018

(51) Int. Cl.

*E06B 9/80* (2006.01)
*E06B 9/17* (2006.01)
*E06B 9/11* (2006.01)

(52) U.S. Cl.

CPC ..... *E06B 9/17046* (2013.01); *E06B 9/11* (2013.01); *E06B 9/80* (2013.01); *E06B 2009/804* (2013.01); *E06B 2009/805* (2013.01); *Y10T 292/0911* (2015.04)

(58) Field of Classification Search

CPC ..... E06B 9/11; E06B 9/80; E06B 2009/801; E06B 2009/804; E06B 2009/805; E06B 9/581; E06B 9/58; E06B 9/17046; E06B 9/56; E06B 2009/802; E06B 9/72; Y10T 292/0848; Y10T 292/0849; Y10T 292/0911; Y10T 292/0921; Y10T 292/0922; Y10S 292/36

USPC ..... 70/95, 99, 100

See application file for complete search history.

(56) References Cited

U.S. PATENT DOCUMENTS 1,384,794 A * 7/1921 Wing ..... E05B 83/02 292/24
1,929,479 A * 10/1933 Campbell ..... E05B 65/0007 292/205
2,521,455 A * 9/1950 Gorgun ..... E06B 9/54 160/239
4,175,608 A * 11/1979 Alten ..... E06B 9/13 160/273.1
5,092,388 A * 3/1992 Evers ..... E06B 9/521 160/26
7,360,575 B2 * 4/2008 Weiss ..... A47F 3/0469 160/264
2009/0229767 A1 * 9/2009 Mullet ..... E06B 9/581 160/26
2013/0112358 A1 * 5/2013 Hardison, III ..... E06B 9/86 160/340
2013/0312920 A1 * 11/2013 Mullet ..... E06B 9/40 160/310

* cited by examiner

*Primary Examiner* — Katherine W Mitchell
*Assistant Examiner* — Jeremy C Ramsey
(74) *Attorney, Agent, or Firm* — Mitchell A. Smolow

(57) ABSTRACT

A closure locking design is presented that is more resistant to a displacement/dislodgement force. A closure end strip is fixed to a closure end and received by a closure guide first section. A rotatable tube and hook assembly run vertically within a closure guide second section. When rotated to a locking position a hook member of the tube and hook assembly rotates through a slot cut in the guide and through a cutout in the closure end strip to restrictively engage the closure.

27 Claims, 10 Drawing Sheets

FIG. 11
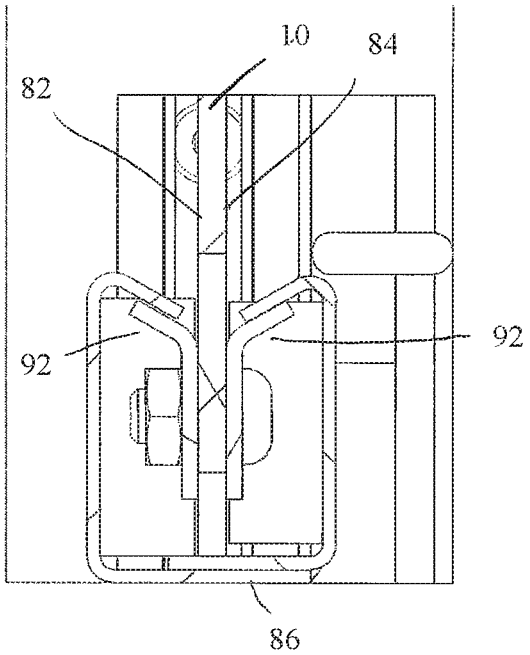
FIG. 12
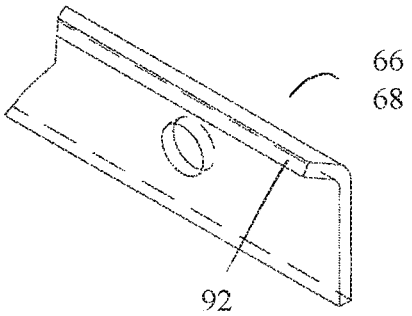
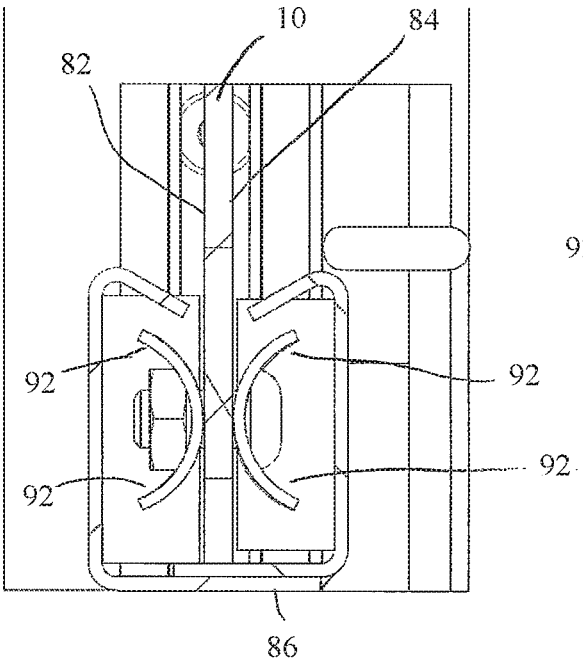
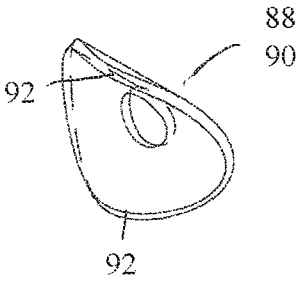
FIG. 14
FIG. 13

OVERHEAD CLOSURE WITH TUBE AND HOOK END LOCK

FIELD OF THE INVENTION

This invention relates generally to closures and in particular, to a closure with a hook and tube endlock.

BACKGROUND OF THE INVENTION

Access openings, for example, in warehouse, manufacturing and industrial settings are often secured by overhead (vertically traveling) closures. One popular type of overhead closure is a coiling closure, for example, mesh or slatted doors, such as rolling steel doors. These closure types move in a generally vertical path coiling above the opening as the door is opened. Because overhead coiling closures have many fewer parts than other door types with less risk for damage and inoperability, they often make a better solution for facilities that cannot afford opening downtime.

An overhead coiling closure is generally provided with a powered operator to power the door to an open or closed position, manually opened and closed with, for example, a looped chain or crank, or is hand lifted aided by spring tension. A shaft is horizontally mounted above the access opening to wind or unwind the coiling closure. The coiling shaft and operator (if present) are usually covered by a hood.

Another popular type of overhead closure is a sectional overhead door. Sectional overhead doors are manufactured from horizontally hinged panels that roll into an overhead position on tracks, usually spring-assisted. Each panel of the sectional overhead door has its own connection to the door track. This increases reliability and robustness compared to monolithic doors which have only a couple of track connections for the whole panel.

A sectional overhead door may be provided with a powered operator (motor) operatively connected to a panel to power the door to an open or closed position, or it may be manually opened and closed, for example with a handle.

Both coiling and sectional closures use a pair of tracks or door guides mounted to the structure at opposite sides of the access opening. In addition to providing operative guidance, the guides insure the closure can act as a secure barrier to prevent unauthorized entry when closed.

For many applications the locking capability provided by the operator alone is not sufficient. Consequently it is necessary to provide additional locking to achieve required security.

Closure designs attempt to minimize the chance for catastrophic displacement, either intentional or unintentional, of the door from the door guide, which would allow unwanted or unauthorized entry. For example, when struck, the door will bow and if the displacement force is great enough the door can dislodge from its guide, allowing passage between the door and side wall, thereby no longer providing a secure barrier.

Accordingly, there is a continuing need for improved door protection designs. The present invention fulfills this need and further provides related advantages.

BRIEF SUMMARY OF THE INVENTION

In a preferred embodiment a novel door locking design is presented that is more resistant to a displacement/dislodgement force. When locked, the tube and hook end lock provides increased end retention to keep the closure within the guide upon receiving a displacing force and simultaneously limits motion of the closure in all three axis. It prevents dislodgement of the closure from being lifted upward, laterally (pulling out of the guides), and normal (pushing or pulling the curtain) to the opening.

A closure end is received by a closure guide first section. A rotatable tube and hook assembly run vertically within a closure guide second section. When rotated to a locking position a hook member of the tube and hook assembly rotates though a slot cut in the guide and through a cutout in the closure end to lockingly engage the closure.

An important feature of the design is that the closure end is not thicker than the closure itself. This provides an advantage particularly with coiling closures because it does not add dimension to the coil diameter as the closure is coiled up, therefore making an evenly round coil with no stress points added.

When used with a sectional door an advantage of the tube and hook endlock is that if a lower or upper panel is defeated the hooks will hold the panels above or below the defeated panel in place, making removal of the closure from the door track more difficult, thereby making the door more secure.

Another advantage of the invention when used with all closure types is that it prevents wind loading or other natural forces from dislodging the closure from the guides.

Other features and advantages of the present invention will be apparent from the following more detailed description of the preferred embodiments, taken in conjunction with the accompanying drawings which illustrate, by way of example, the principles of the invention.

BRIEF DESCRIPTION OF THE DRAWINGS

The accompanying drawings are included to provide a further understanding of the present invention. These drawings are incorporated in and constitute a part of this specification, illustrate one or more embodiments of the present invention, and together with the description, serve to explain the principles of the present invention.

FIG. 11 is an end view of the bottom bar assembly with two continuous angles.

FIG. 12 is a perspective view of a continuous angle of FIG. 11.

FIG. 13 is an end view of the bottom bar assembly with cured washers.

FIG. 14 is a perspective view of a curved washer of FIG. 13.

Figure 1:
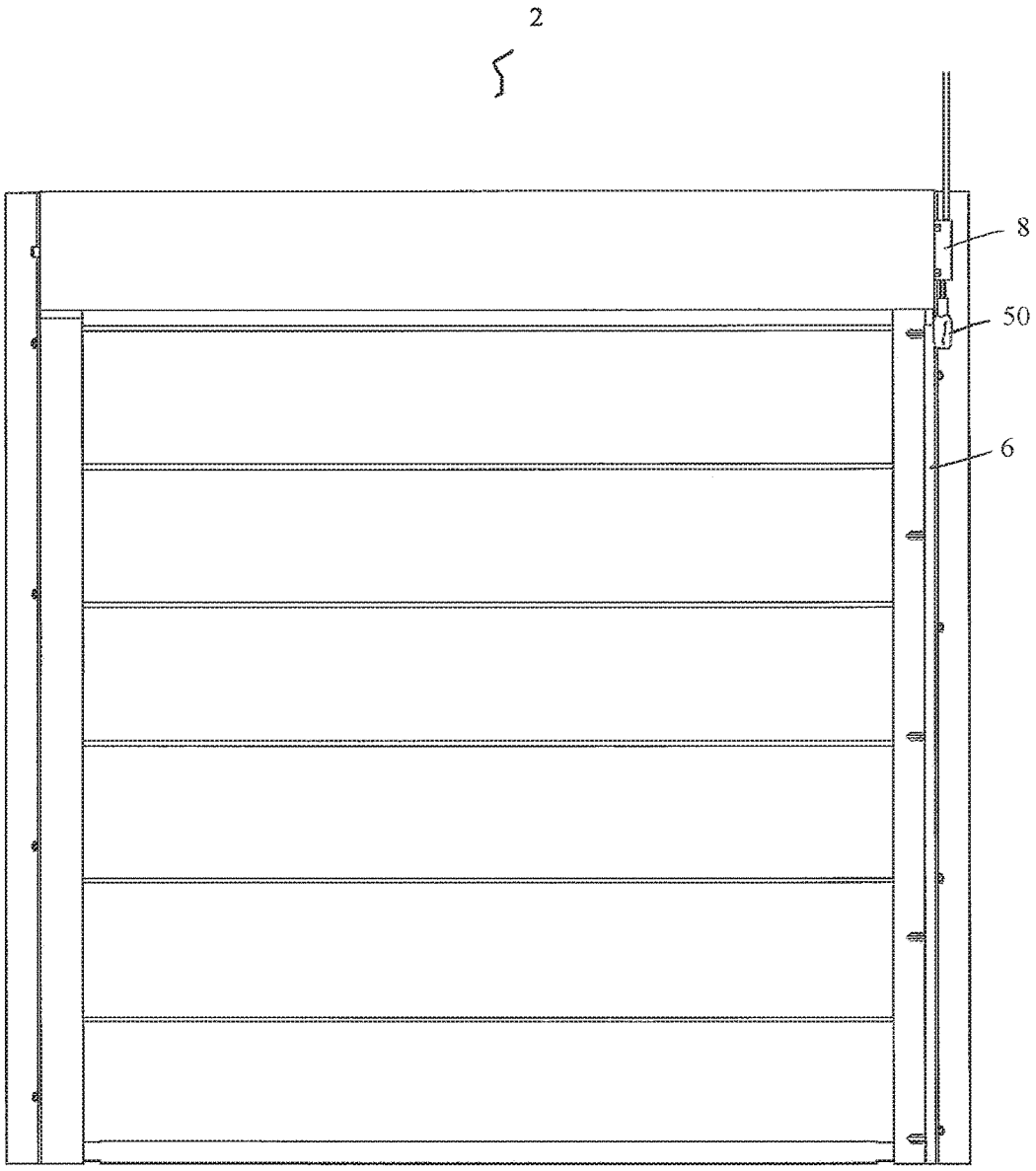
FIG. 1 is a front view of a closed sectional closure.

Other features and advantages of the present invention will be apparent from the following more detailed description of the preferred embodiments, taken in conjunction with the accompanying drawings which illustrate, by way of example, the principles of the invention.

DETAILED DESCRIPTION OF THE INVENTION

As required, detailed embodiments of the present invention are disclosed; however, it is to be understood that the disclosed embodiments are merely exemplary of the invention that may be embodied in various forms. The figures are not necessarily to scale, and some features may be exaggerated to show details of particular components. Therefore, specific structural and functional details disclosed are not to be interpreted as limiting, but merely as a basis for the claims and as a representative basis for teaching one skilled in the art to variously employ the present invention. Where possible, like reference numerals have been used to refer to like parts in the several alternative embodiments of the present invention described herein.

Figure 2:
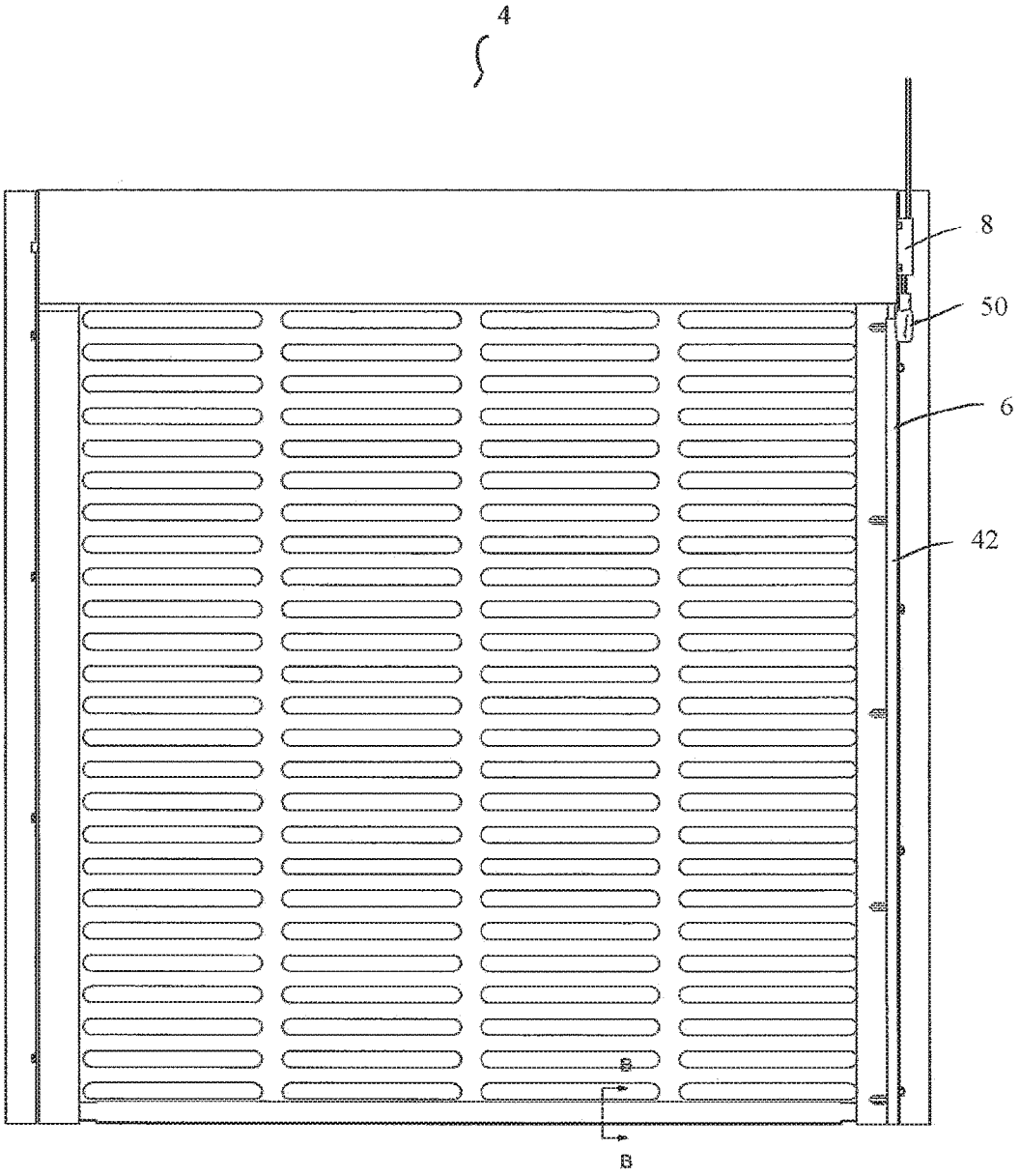
FIG. 2 is a front view of a closed overhead coiling closure.

FIGS. 1 and 2 depict a closed overhead sectional and a closed overhead coiling closure 2, 4 respectively. Both closure types use a pair of door guide assemblies, one guide assembly 6 fixed to the structure at opposite sides of the closure to operatively receive the closure. An optional operator 8, for example, a motor, chain assembly, or spring tension, is operatively attached to the closure to open and close the closure.

While an overhead coiling closure is described below to detail the tube and hook end lock, the end lock is not limited to an overhead coiling door. One skilled in the art can readily visualize that the mechanism as detailed with a coiling overhead closure is easily transferred to a sectional or horizontal closure.

Figure 3:
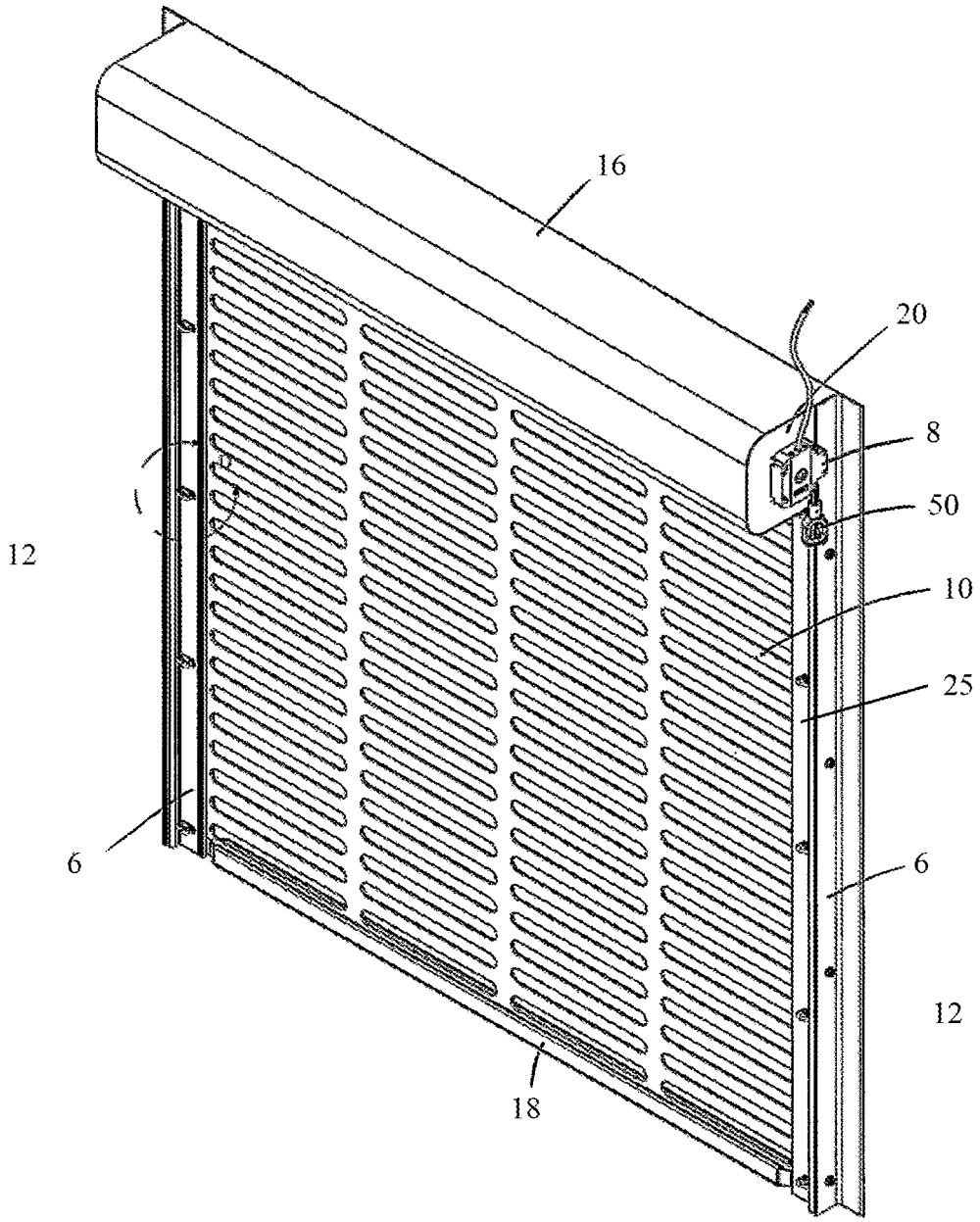
FIG. 3 is a perspective view of a closed overhead coiling closure.
Figure 4:
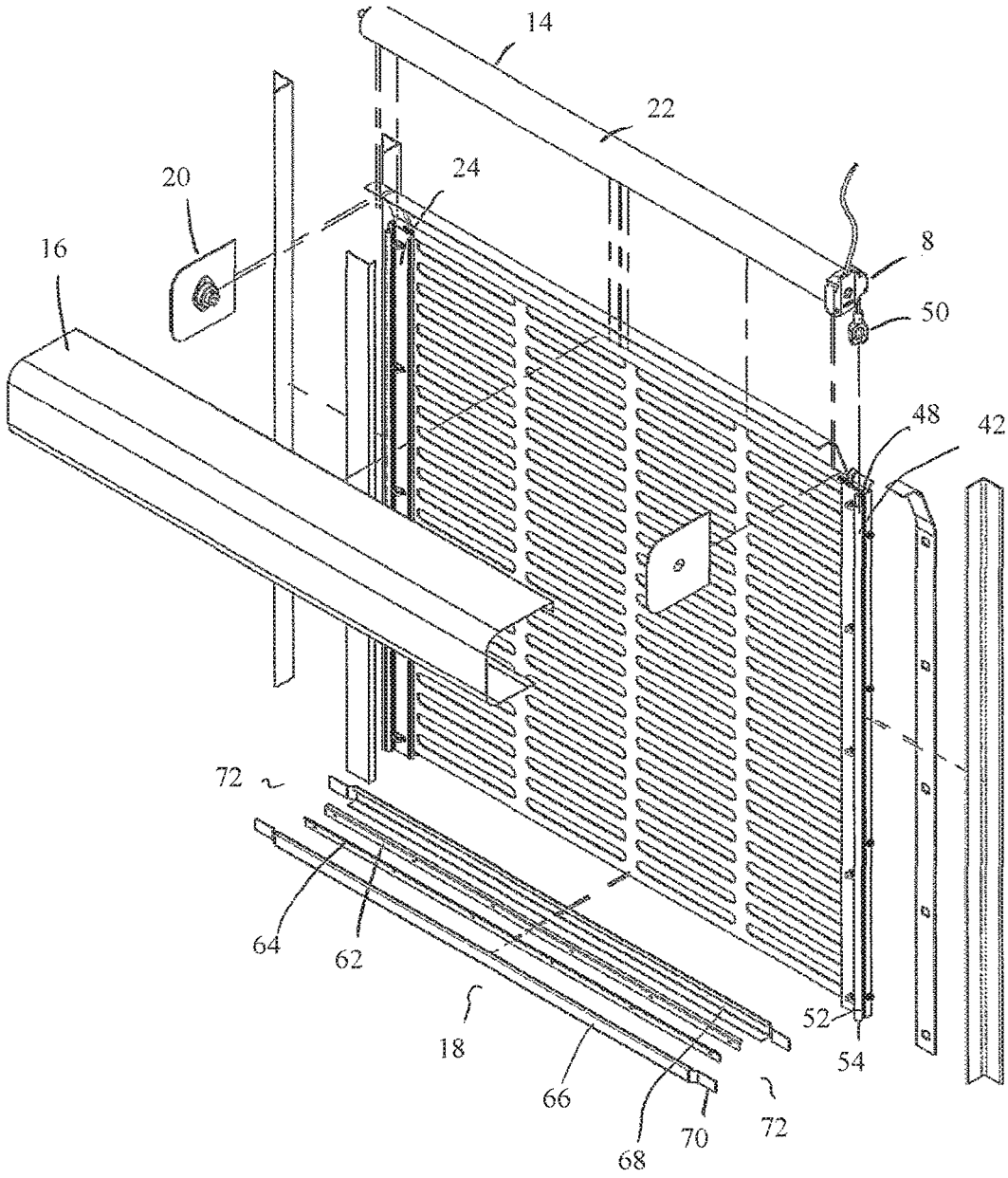
FIG. 4 is a perspective exploded view of the coiling closure of FIG. 3.

With that in mind, turning to FIGS. 3 and 4, an overhead coiling closure is comprised of a closure material 10, for example, a linked or fabric curtain, guide assemblies 6 mounted to the building structure at each closure side 12, a counterbalance assembly 14, for example, a shaft or tube 22, and an operator 8, for example, a tube motor. The counterbalance assembly 14 and operator 8 are preferably contained within a covering 16, for example, a hood. The closure material 10 is fixed to a bottom bar assembly 18.

The counterbalance assembly 14 is supported above the access opening and secured at each end by a securing member 20, for example, a bracket. The closure material 10 attaches to the counterbalance assembly 14 and rolls onto and off of the counterbalance assembly 14 for example, as the tube 22 is rotated, optionally by the tube motor 8. A closure end 25 travels within the vertically oriented side guide assemblies 6. The closure end 25 optionally comprises a geometry which is mechanically locked within the guide assemblies 6.

Depending on the type of closure material 10, each closure end 25 optionally comprises a closure end strip 24 fixed to the closure material 10. For example, a slatted closure material would not require a separate end strip to accommodate the retentive features described below, whereas, for example, a closure material comprised of linked horizontal rods would require the below described retentive features be incorporated into an end strip. While the description below references an end strip, it should be apparent that the retentive features described could be incorporated directly into the closure material end without an end strip, depending on the closure material.

Figure 6:
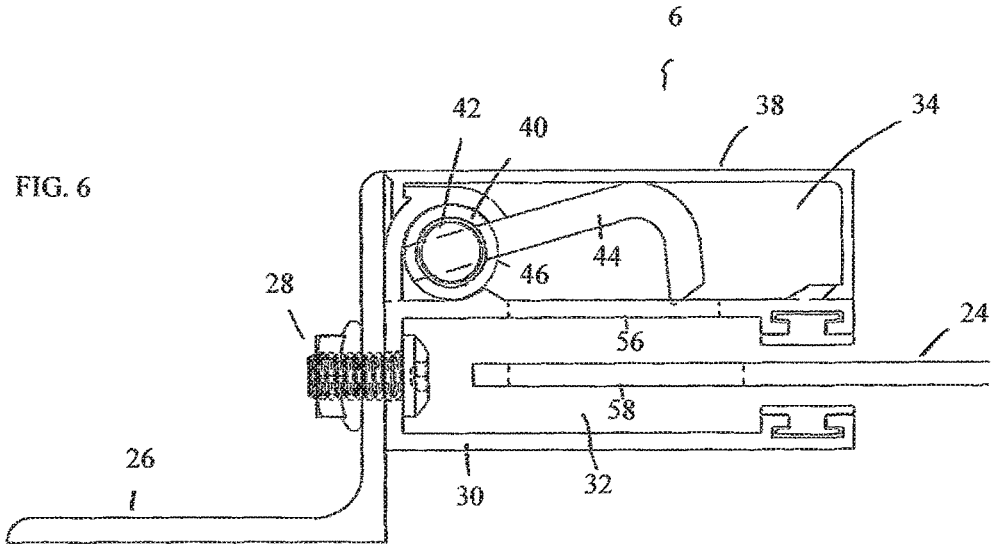
FIG. 6 is a bottom view of the tube and hook assembly with the hook in an unlocked position.
Figure 7:
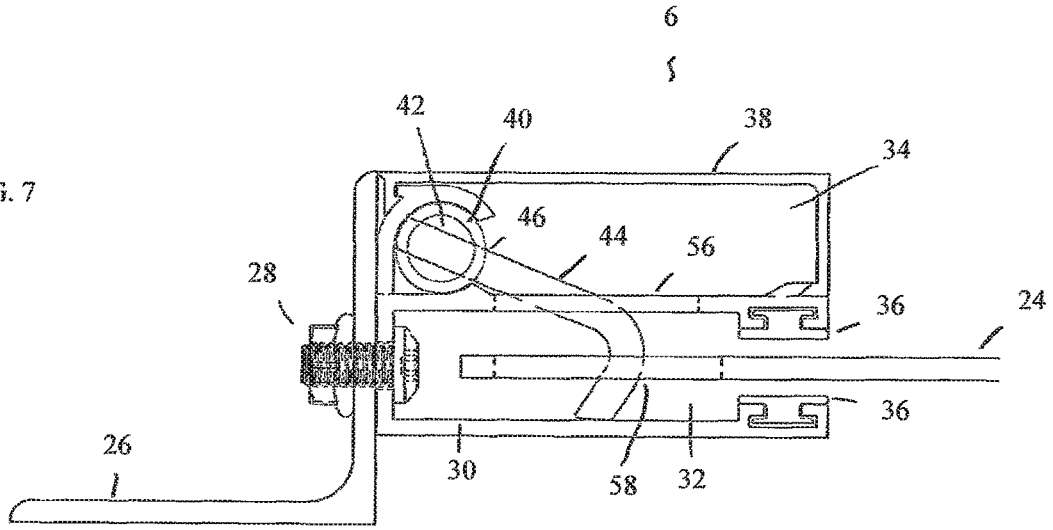
FIG. 7 is a bottom view of the tube and hook assembly with the hook in a locked position.

As depicted in FIGS. 6 and 7, each guide assembly 6 comprises a wall mounting element 26 mounted with mounting hardware 28 to a guide extrusion 30. The guide extrusion 30 comprises a closure guide first section 32, a closure guide second section 34, and optional guide wear strips 36. Guide trim 38 attaches, preferably removably attaches, to the guide extrusion 30.

The closure end strip 24 travels within the closure guide first section 32. A tube and hook assembly 40 is contained within the closure guide second section 34 which is covered by the guide trim 38, preferably removably covered.

Figure 8:
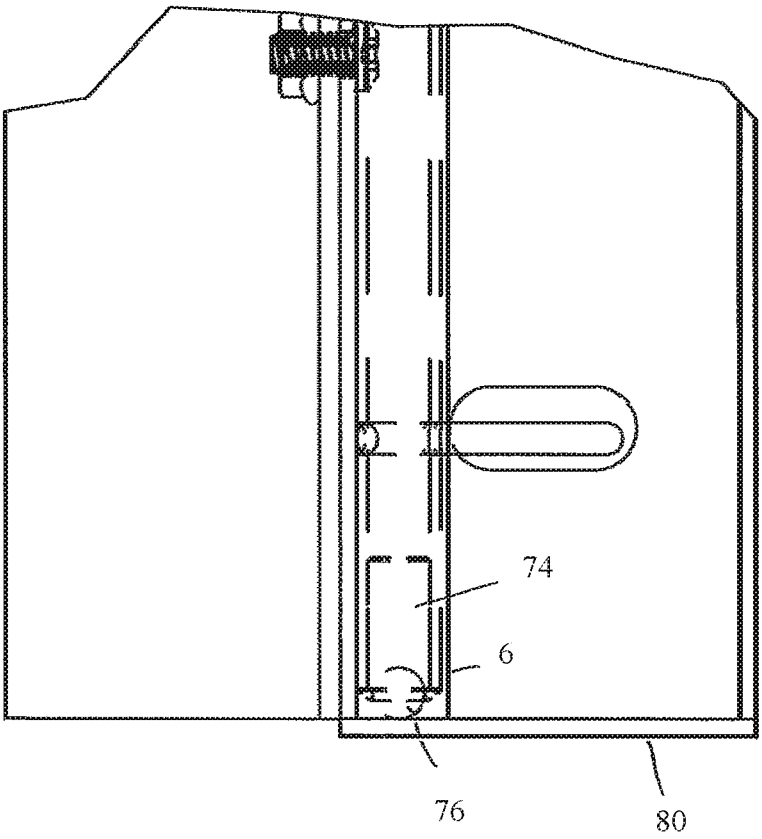
FIG. 8 is a front view of the ball plunger and plate.
Figure 9:
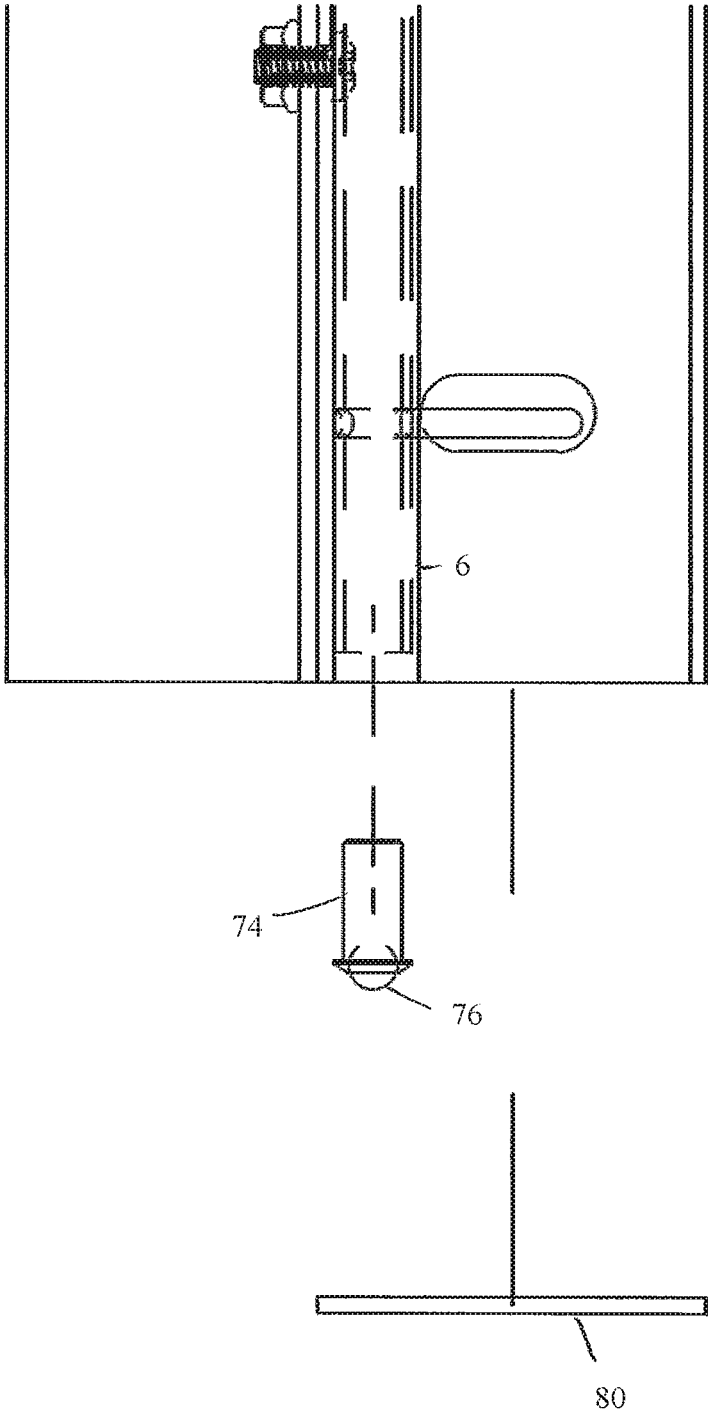
FIG. 9 is an exploded view of the ball plunger and plate of FIG. 8
Figure 10:
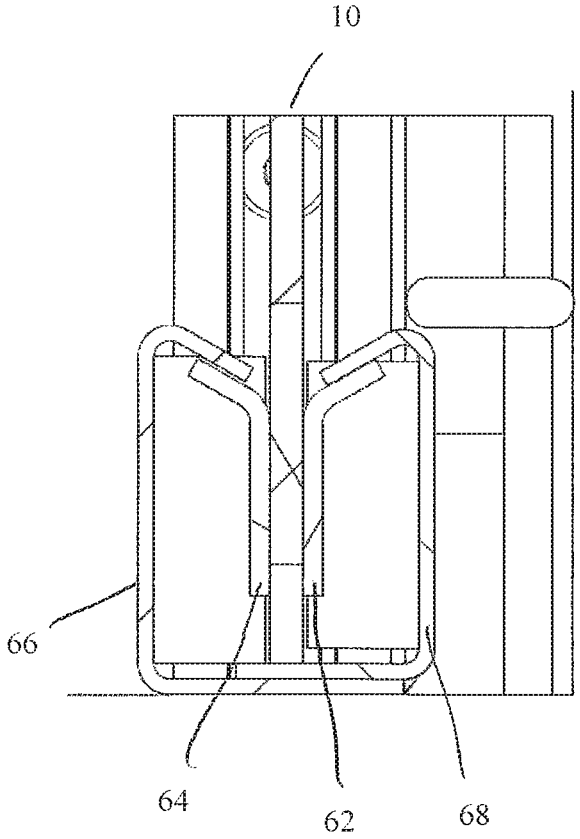
FIG. 10 is an end view of the bottom bar assembly taken at section B-B of FIG. 2.

The tube and hook assembly 40 comprises an elongated member 42, for example, a tube or rod, to which is attached at least one hook 44. The elongated member 42 comprises a first end 48 operatively attached to an actuator 50 (FIGS. 2-4), for example, a low speed, high torque motor mounted to the securing member 20, and a second end 52 comprising a rotation point 54, for example, a ball plunger, optionally spring loaded 74, or a ball bearing 76 (FIGS. 8 and 9). The rotation point 54 rests on the floor or optionally on a rotation point receiving member 80, for example, a steel plate, mounted to a guide assembly 6.

If the tube and hook assembly 40 becomes damaged it is easily repaired or replaced by removing the guide trim 38 and removing the tube and hook assembly 40 upward to remove from the guide assembly 6. Optionally, to aid in removal, the tube and hook assembly 40 is segmented, each segment removably fixed to its adjacent segment(s), for example, threadingly fixed and pinned to its adjacent segment(s), so that full height clearance above the guide assembly 6 is not needed for servicing. Each segment can be disengaged and removed from its adjacent segment(s) as it clears the guide assembly.

In a preferred embodiment the elongated member 42 comprises a tube having an orifice 46 with the hook 44 passing therethrough.

Figure 5:
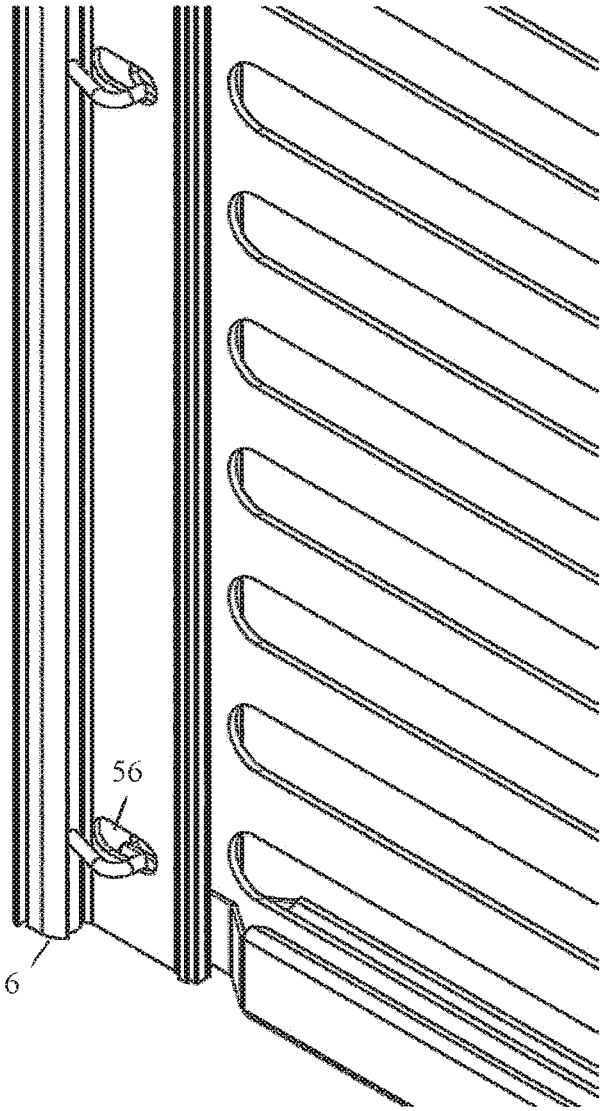
FIG. 5 is a perspective view of a portion of the tube and hook assembly with the hook in an unlocked position.

Turning to FIGS. 5-7, the guide assembly 6 further comprises guide assembly slot 56, and closure end strip 24 further comprises end strip cutout 58, both located such that when the closure 2, 4 is closed and tube and hook assembly 40 is actuated, hook 44 is passed through the aligned guide assembly slot 56 and closure end strip cutout 58, thereby securing the closure 2, 4. Preferably closure end strip cutout 58 is a larger cutout relative to the guide assembly slot 56 to allow for alignment despite inconsistencies in closure assembly and/or closure material 10 stretch from usage.

While a single hook 44 has been described, preferably a plurality of respective hooks 44, guide assembly slots 56, and closure end strip cutouts 58 are utilized to provide increased closure displacement resistance.

The closure material 10 is fixed to a bottom bar assembly 18 having bottom bar ends 72. Turning to FIGS. 4 and 10-14, in one form the bottom bar assembly 18 comprises a first and second closure material mounted element 82, 84 mounted to a first 82 and second 84 side, respectively, of the closure material 10. A retaining extension 92 extends from each end of the closure material mounted elements 82, 84 to slidingly receive and retain a bottom bar 86. A tab 70 extends from each end 72 of the bottom bar assembly 18 such that when assembled, the tabs 70 insert into the guide assembly first section 32.

In one embodiment, the first and second closure material mounted elements 82, 84 are a first and second bottom bar angle 66, 68 (FIGS. 11 and 12). Alternatively, in a preferred embodiment, the first and second closure material mounted elements 82, 84 are a first and second curved washer 88, 90 (FIGS. 13 and 14), the curvature acting as the retaining extension 92.

Although the present invention has been described in connection with specific examples and embodiments, those skilled in the art will recognize that the present invention is capable of other variations and modifications within its scope. These examples and embodiments are intended as typical of, rather than in any way limiting on, the scope of the present invention as presented in the appended claims.

What is claimed is:

1. A closure system comprising:

a guide assembly;

a closure mounted to a supported counterbalance assembly and movably contained within the guide assembly;

an operator operatively attached to the counterbalance assembly; and a tube and hook assembly contained within the guide assembly and reversibly received by the closure;

wherein the guide assembly comprises a wall mounting element fixed to a guide extrusion; the guide extrusion comprising a closure guide first section to receive the closure and a closure guide second section to contain the tube and hook assembly; and the tube and hook assembly comprises an elongated member having a first end operatively attached to an actuator and a second end comprising a rotation point; and at least one hook attached to the elongated member; the guide assembly further comprising a guide assembly slot located such that when the closure is closed and the tube and hook assembly is actuated, the hook passes through the guide assembly slot to restrictively engage the closure.

2. The closure system of claim 1 further comprising a bottom bar assembly fixed to the closure, the bottom bar assembly comprising a tab extending from an end which inserts into the closure guide first section, a first and second closure material mounted element mounted to a first and second side, respectively, of the closure material; wherein a retaining extension extends from each closure material mounted element to slidingly receive and retain a bottom bar.

3. The closure system of claim 2 wherein the each closure material mounted element is a curved washer.

4. The closure system of claim 1 further comprising wear strips mounted to the closure guide first section.

5. The closure system of claim 1 further comprising a guide trim attached to the guide extrusion.

6. The closure system of claim 1 wherein the closure comprises a closure material and a closure end strip having a closure end strip cutout, the closure end strip fixed to a side of the closure material and received by the closure guide first section; wherein the tube and hook assembly comprises an elongated member having a first end operatively attached to an actuator and a second end comprising a rotation point; at least one hook attached to the elongated member; and the guide assembly further comprises a guide assembly slot located such that when the closure is closed and the tube and hook assembly is actuated, the hook passes through the guide assembly slot and closure end strip cutout.

7. The closure system of claim 6 wherein the closure end strip cutout is larger relative to the guide assembly slot and the closure end strip is not thicker than the closure material.

8. The closure system of claim 1 wherein the closure comprises a closure material end having a closure material end cutout; wherein the tube and hook assembly comprises an elongated member having a first end operatively attached to an actuator and a second end comprising a rotation point; at least one hook attached to the elongated member; and the guide assembly further comprises a guide assembly slot located such that when the closure is closed and the tube and hook assembly is actuated, the hook passes through the guide assembly slot and closure material end cutout.

9. The closure system of claim 8 wherein the closure material end cutout is larger relative to the guide assembly slot.

10. The closure system of claim 1 further comprising a rotation point receiving member fixed to the guide assembly.

11. The closure system of claim 1 wherein the elongated member comprises separable segments.

12. The closure system of claim 1 wherein the tube and hook assembly comprises a tube having an orifice with the hook passing therethrough.

13. A tube and hook locking system comprising:

a guide assembly comprising a wall mounting element fixed to a guide extrusion;

the guide extrusion comprising a closure guide first section and a closure guide second section; and a hook and tube assembly contained within the closure guide second section;

wherein the tube and hook assembly comprises an elongated member having a first end operatively attached to an actuator and a second end comprising a rotation point; and at least one hook attached to the elongated member; and the guide assembly comprises a guide assembly slot located such that when the tube and hook assembly is actuated, the hook passes through the guide assembly slot to restrictively engage a closure.

14. The locking system of claim 13 further comprising wear strips mounted to the closure guide first section.

15. The locking system of claim 13 further comprising a guide trim attached to the guide extrusion.

16. The locking system of claim 13 wherein the elongated member comprises separable segments.

17. The locking system of claim 13 further comprising a rotation point receiving member fixed to the guide assembly.

18. The locking system of claim 13 wherein the rotation point comprises a ball plunger.

19. A closure system comprising:

a first and second guide assembly;

a closure comprising a closure material and a first and second closure end strip fixed to a respective first and second side of the closure material; the closure fixed to a counterbalance assembly supported by securing members; the first and second closure end strip movably contained within the respective first and second guide assembly;

an operator operatively attached to the counterbalance assembly;

a first and second tube and hook assembly contained within a respective first and second guide assembly and reversibly restrictively received by the respective first and second closure end strip; and a bottom bar assembly fixed to the closure, the bottom bar assembly comprising a first and second bottom bar tab assembly extending from a respective first and second bottom bar end;

wherein the first and second respective closure end strip are not thicker than the closure material;

each guide assembly comprises a wall mounting element fixed to a guide extrusion; the guide extrusion comprising a closure guide first section having wear strips to receive a closure end strip and a bottom bar tab assembly; and a closure guide second section to contain a tube and hook assembly;

a guide strip is attached to the guide extrusion; and each closure end strip comprises a closure end strip cutout each guide assembly further comprises a guide assembly slot and each tube and hook assembly comprises an elongated member having a first end operatively attached to an actuator and a second end comprising a rotation point and at least one hook attached to the elongated member; such that when the closure is closed and the tube and hook assembly is actuated, a respective hook passes through a respective guide assembly slot and respective closure end strip cutout.

20. The closure system of claim 19 wherein the respective closure end strip cutout is larger relative to the respective guide assembly slot.

21. The closure system of claim 19 further comprising a rotation point receiving member fixed to the guide assembly.

22. The closure system of claim 19 wherein the elongated member comprises separable segments.

23. The closure system of claim 19 wherein the tube and hook assembly comprises a tube having an orifice with the hook passing therethrough.

24. The closure system of claim 19 wherein the first and second bottom bar tab assembly each inserts into a respective first and second closure guide first section; and the bottom bar assembly further comprises a first and second closure material mounted element mounted to a first and second side, respectively, of the closure material; wherein a retaining extension extends from each closure material mounted element to slidingly receive and retain a bottom bar.

25. The closure system of claim 24 wherein the each closure material mounted element is a curved washer.

26. The closure system of claim 24 wherein the each closure material mounted element is a bottom bar angle.

27. The closure system of claim 19 wherein the rotation point is a ball plunger.

* * * * *